US010286257B2

(12) United States Patent
Ison

(10) Patent No.: US 10,286,257 B2
(45) Date of Patent: May 14, 2019

(54) FLOTATION DEVICE

(71) Applicant: HOVERFISH BABY, LLC, Houston, TX (US)

(72) Inventor: Kristi Ison, Houston, TX (US)

(73) Assignee: HOVERFISH BABY, LLC, Houston, TX (US)

( * ) Notice: Subject to any disclaimer, the term of this patent is extended or adjusted under 35 U.S.C. 154(b) by 0 days.

(21) Appl. No.: 15/866,893

(22) Filed: Jan. 10, 2018

(65) Prior Publication Data

US 2018/0200578 A1 Jul. 19, 2018

Related U.S. Application Data

(60) Provisional application No. 62/445,928, filed on Jan. 13, 2017.

(51) Int. Cl.
*B63C 9/08* (2006.01)
*B63C 9/28* (2006.01)
(Continued)

(52) U.S. Cl.
CPC ..... *A63B 31/00* (2013.01); *B63B 35/76* (2013.01); *B63C 9/155* (2013.01); *A63B 2208/12* (2013.01); *A63B 2209/10* (2013.01); *A63B 2225/09* (2013.01); *A63B 2225/605* (2013.01); *A63B 2225/62* (2013.01)

(58) Field of Classification Search
CPC . A63B 31/00; A63B 2208/00; A63B 2208/03; A63B 2208/12; A63B 2225/60; A63B 2225/605; A63B 2225/62; B63C 9/08; B63C 9/081; B63C 9/082;
(Continued)

(56) References Cited

U.S. PATENT DOCUMENTS 2,946,068 A * 7/1960 Jasper ..... A47C 15/006 441/130
3,074,084 A * 1/1963 Bisch ..... A47C 15/006 441/131
(Continued)

FOREIGN PATENT DOCUMENTS

CN 2631936 Y 8/2004
CN 201172480 Y 12/2008
(Continued)

OTHER PUBLICATIONS

Adjustable Inflatable Toddler Baby Swim Ring Swimming Neck Float Ring, https://www.dhgate.com/product/adjustable-colorful-inflatable-new-baby-aids/245578161.html#s1-5-1;supl|141175268, as accessed Dec. 5, 2016, 11 pages.
(Continued)

*Primary Examiner* — Daniel V Venne
(74) *Attorney, Agent, or Firm* — Hahn Loeser & Parks LLP

(57) ABSTRACT

The invention includes a floatation device. The floatation device includes a body fabricated from a buoyant foam, and the body comprises an outer side wall, a top side comprising a downwardly sloped portion and a level portion, an inner opening at the center of the level portion, and a division extending from the outer side wall to the inner opening. The floatation device may also include one or more front, rear, and/or side extensions as well as one or more inserts, in some embodiments.

19 Claims, 9 Drawing Sheets

(51) Int. Cl.

| | |
|---|---|
| ***A63B 31/00*** | (2006.01) |
| ***B63B 35/76*** | (2006.01) |
| ***B63C 9/15*** | (2006.01) |

(58) Field of Classification Search

CPC .. B63C 9/15; B63C 9/155; B63C 9/18; B63B 35/74; B63B 35/76; B63B 35/78

USPC ..... 441/129, 131, 132

See application file for complete search history.

(56) References Cited

U.S. PATENT DOCUMENTS

| | | | | |
|---|---|---|---|---|
| 3,147,498 | A * | 9/1964 | Convis | A63B 69/14 297/DIG. 3 |
| 3,860,976 | A * | 1/1975 | Suyama | B63B 35/74 297/DIG. 3 |
| 4,799,910 | A * | 1/1989 | Kellough | A47C 15/006 441/130 |
| 6,589,089 | B1 * | 7/2003 | Glass | A47C 15/006 297/250.1 |
| 6,948,991 | B2 | 9/2005 | Zhao | |
| D603,926 | S | 11/2009 | Merker et al. | |
| D610,216 | S | 2/2010 | Le Gette et al. | |
| D650,462 | S | 12/2011 | Parten | |
| D658,257 | S | 4/2012 | Whitehead | |
| 9,248,888 | B2 | 2/2016 | Chiu | |

FOREIGN PATENT DOCUMENTS

| | | | |
|---|---|---|---|
| CN | 201665310 | U | 12/2010 |
| CN | 202368771 | U | 8/2012 |
| CN | 202777642 | U | 3/2013 |
| CN | 202783736 | U | 3/2013 |
| CN | 203005722 | U | 6/2013 |
| CN | 203246575 | U | 10/2013 |
| CN | 103395485 | A | 11/2013 |
| CN | 103599626 | A | 2/2014 |
| CN | 203512008 | U | 4/2014 |
| DE | 202011000334 | U1 | 5/2011 |
| JP | 2002264891 | A | 9/2002 |
| TW | M266939 | U | 6/2005 |
| TW | D119130 | | 9/2007 |
| WO | 2016128857 | A1 | 8/2016 |

OTHER PUBLICATIONS

Dual SRS Airbags Baby Swimming Ring webpage, http://www.qqbabies.com/index/php?main_page=product_info&products_id=4, as accessed Dec. 5, 2016, 3 pages.

Swimming Neck Ring webpage, http://www.walentoys.com/index.php?_m=mod_product&_a=view&p_id=386, as accessed Dec. 5, 2016, 3 pages.

The "Floating Neck Collar"—Your Baby Can Swim! article from The Pediatric Insider website, https://pediatricinsider.wordpress.com/2013/08/21/your-baby-can-swim-the-floating-neck-collar/, as accessed Dec. 5, 2016, 2 pages.

* cited by examiner

FLOTATION DEVICE

CROSS REFERENCE TO RELATED APPLICATIONS

This application is a non-provisional application of, and claims priority to, U.S. patent application Ser. No. 62/445,928, filed Jan. 13, 2017 with the U.S. Patent Office, which is hereby incorporated by reference.

TECHNICAL FIELD

The invention may be broadly described as a floatation device. More particularly, the invention is a floatation device used for hydrotherapy that allows a user to float vertically in water, unassisted, while keeping his or her head above the water level.

BACKGROUND OF THE INVENTION

One type of hydrotherapy consists of providing a user with a floatation device that allows the user to float vertically in water, unassisted, while keeping his or her head above the water level. A hydrotherapy session is typically for 10 to 20 minutes and allows a user to float while having full freedom of movement within the floatation device. This enables full body movement for the user, which promotes strength and/or brain development through exercise.

During each hydrotherapy float session, users wear a floatation device around their necks that allows for a secure fit for their size. The water is maintained between 95 and 98 degrees Fahrenheit and can be purified through an ozone system. Hydrotherapy has been shown to provide infants, in particular, with increased muscular and skeletal power, a strengthened respiratory system, and increased cognitive development, among others. Another benefit to hydrotherapy for infants, in particular, is that infants utilize their entire bodies at a very early age, which is beneficial due to the lack of independent physical movement before they begin crawling.

Floatation devices that are used for hydrotherapy are typically inflatable and round in overall shape. These features suffer from a number of deficiencies. Typical inflatable floatation devices have too much variability in their inflation from user to user and often leak after just a few uses. In addition, the typical round shape of floatation devices restricts users' movement of their arms, making the devices less effective and awkward for the users.

The present invention overcomes the deficiencies in the prior art by being fabricated from safety foam and having a shape more conducive to full freedom of movement by infants, in particular, while providing safer floatation characteristics. The present invention can also accommodate users and, in particular, infants, of different sizes and weight, allowing it to accommodate different users or infants as they mature and grow.

SUMMARY OF THE INVENTION

Embodiments of the invention include a floatation device.

In particular embodiments, a floatation device is provided comprising a body fabricated from a buoyant foam. The body comprises an outer side wall and a top side. The top side comprises a downwardly sloping portion, wherein the downwardly sloping portion extends inwardly from the outer side wall. The top side further comprises a level portion wherein the downwardly sloped portion extends into and connects said level portion to the outer side wall. The body further comprises an inner opening at the center of the level portion. The body further includes a division extending from the outer side wall to the inner opening.

Particular embodiments of the present invention also include a floatation device comprising a body fabricated from a buoyant foam. The body comprises an outer side wall and a top side. The top side comprises a downwardly sloping portion, wherein the downwardly sloping portion extends inwardly from the outer side wall. The top side further comprises a level portion wherein the downwardly sloped portion extends into and connects said level portion to the outer side wall. The body further comprises an inner opening at the center of the level portion. The body further includes a division extending from the outer side wall to the inner opening. The body further includes one or more front extensions, wherein the outer side wall is an outermost portion of the one or more front extensions and one or more rear extensions, wherein the outer side wall is an outermost portion of the one or more rear extensions. Additionally, the body includes one or more side extensions located between the one or more front extensions and the one or more rear extensions, wherein the outer side wall is an outermost portion of the one or more side extensions, further wherein the division is located on one of the one or more side extensions such that the one of the one or more side extensions contains opposing side extension portions. The floatation device further comprises an insert, wherein the insert is capable of being inserted into the division between the opposing side extension portions.

Particular embodiments of the present invention also include a floatation device comprising a body fabricated from a buoyant foam. The body comprises an outer side wall and a top side. The top side comprises a downwardly sloping portion, wherein the downwardly sloping portion extends inwardly from the outer side wall. The top side further comprises a level portion wherein the downwardly sloped portion extends into and connects said level portion to the outer side wall. The body further comprises an inner opening at the center of the level portion. The body further includes a division extending from the outer side wall to the inner opening. The body further includes one or more front extensions, wherein the outer side wall is an outermost portion of the one or more front extensions and one or more rear extensions, wherein the outer side wall is an outermost portion of the one or more rear extensions. Additionally, the body includes one or more side extensions located between the one or more front extensions and the one or more rear extensions, wherein the outer side wall is an outermost portion of the one or more side extensions, further wherein the division is located on the one or more side extensions such that each of the one or more side extensions contain opposing side extension portions. The floatation device further comprises one or more inserts, wherein each of the one or more inserts is capable of being inserted into the division between the opposing side extension portions of each of the one or more side extensions.

Additional embodiments are described below.

DETAILED DESCRIPTION OF THE INVENTION

While portions of the following discussion relate to the use of the floatation device with infants, it is understood that the floatation device may be used with a variety of users. For example, elderly individuals may use the floatation device during hydrotherapy sessions, and individuals in need of assistance with floating in water, such as those with weaker muscles, may also use the floatation device during hydrotherapy sessions.

Figure 1:
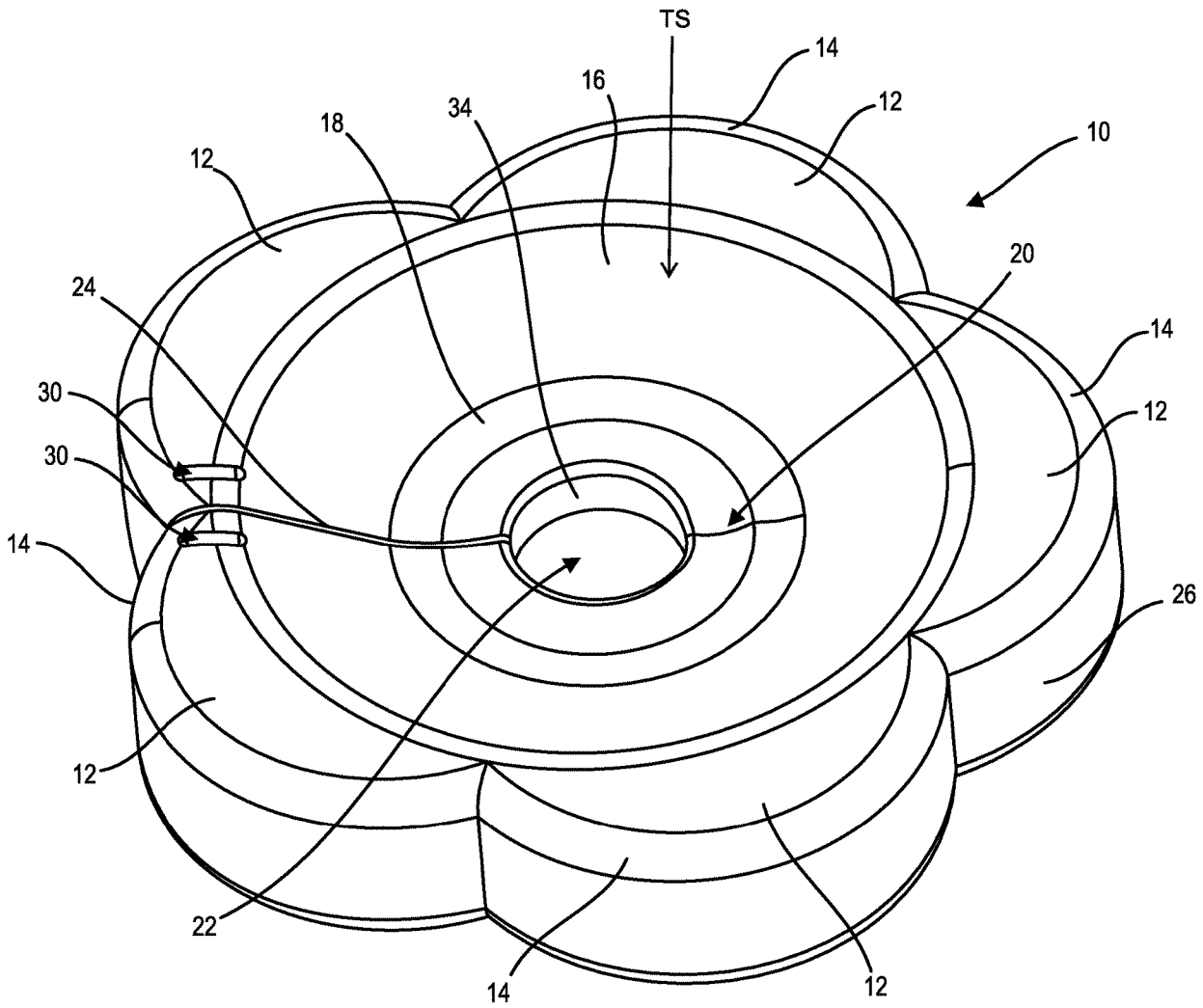
FIG. 1 is a perspective view of one embodiment of the floatation device of the present invention.
Figure 3:
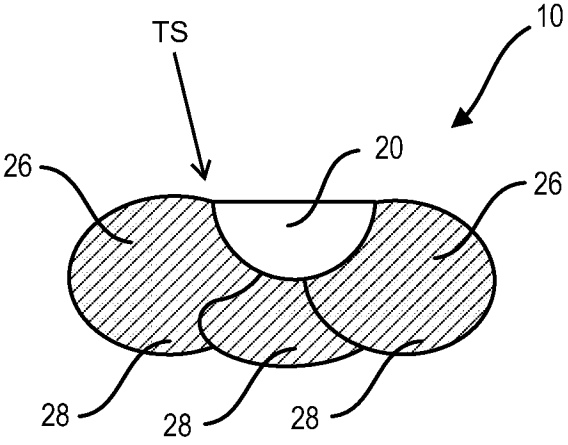
FIG. 3 is a front elevational view in cross-section of the floatation device of the present invention.
Figure 2:
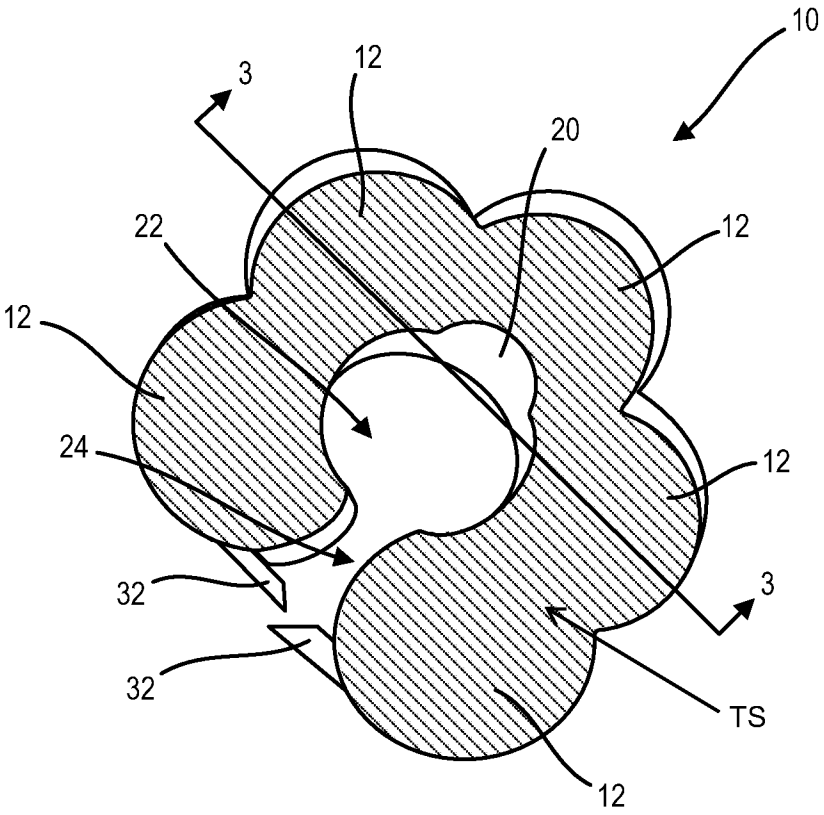
FIG. 2 is a top view of one embodiment of the floatation device of the present invention.

With reference to FIGS. 1 through 3, a floatation device 10 is shown in accordance with the present invention. The body of infant floatation device 10 has a top side TS and is formed as a single piece of buoyant safety foam with five partially circular extensions 12 connected so that, in this embodiment, the outer circular portions of the extensions 12 form a shape similar to flower petals. The inner portions of the partially circular extensions 12 then continue along the top side TS into a generally round and downwardly sloped portion 16, which then ends in leveled portion 18 and inner opening 22.

The floatation device 10 also includes a division 24 between two of the partially circular extensions 12 located at the back of the infant floatation device 10. The two partially circular extensions 12 on either side of division 24 are configured to align when drawn together and secured by a locking mechanism. In one embodiment of the present invention, the locking mechanism is made up of apertures 30 within the floatation device 10 that receive locking straps 32 such that the locking straps 32 are located partially within at least one of the apertures 30. Each locking strap 32 may be between four to six inches in length and includes a clasp (not shown) as is known in the art. In exemplary embodiments, the clasp and the straps 32 should be positioned at the halfway mark of the outer surface of the floatation device 10 when the floatation device 10 is sitting on a flat surface. The clasp comes together and locks, thereby marrying at the division 24. In some embodiments, the clasp provides one snap opening of the locking mechanism, allowing for quicker release of the infant. The clasp could be substituted with hook and loop fasteners, i.e., Velcro® brand, or other types of quick release locking mechanisms that are well known in the art.

When the user of the floatation device 10 is an infant, the infant is placed in the floatation device 10 by pulling apart the circular extensions 12 at the back of the floatation device 10 so as to spread apart division 24, which is then placed around the neck of the infant. The floatation device 10 is then secured around the neck of the infant and provides a secure fit. The floatation device 10 supports the infant with his or her chin in platform 20, which allows the infant's chin to rest flat on platform 20 and even have room for a pacifier, if needed. The platform 20 is between the level portion 18 and the inner opening 22.

In one embodiment, floatation device 10 has an outer diameter of approximately 15 inches, an inner diameter of approximately 3.5 inches, an overall height of approximately 5 inches at outer side wall 26, sloping to an inner diameter height of approximately 1 inch at inner side wall 34, which height fits comfortably under the chin and neck of an infant. Inner side wall 34 surrounds the inner opening 22 at the center of the level portion 18.

The partially circular extensions 12 that form the outer diameter of the floatation device 10 include curved edges 14 that lead from the top side TS of the floatation device 10 to outer side wall 26, which then transitions into one or more bottom portions 28. The bottom portions 28 may be rounded or flat, and they allow for smooth floating and rocking on the water. The high outer side wall 26 prevents water from getting in the user's face.

The configuration of the five partially circular extensions 12 with two of them in the back on either side of division 24 of the floatation device 10 provides increased stability over traditionally round shaped devices. One particular problem with existing devices is that a larger user, such as an infant, or one that moves around excessively, such as a bouncing infant, can tip backwards in the water, creating a hazard. When used with an infant, the "flower" shape of the floatation device 10 provides better stability with two circular extensions 12 at the back of the infant's head, two circular extensions 12 on either side of the infant, and one circular extension 12 in the front of the infant's face.

In one embodiment of the present invention, the body of floatation device 10 is fabricated from ethylene vinyl acetate ("EVA"), which is an elastomeric polymer that produces materials which are rubber-like in softness and flexibility. One characteristic of EVA that is particularly useful for the invention is that it is buoyant. The floatation device 10 formed from EVA is then coated with POLYSCAN Liquid Power, which is a high quality, vinyl concentrate, dry blend replacement used to cover pool floats and similar products. POLYSCAN is safe for skin contact. While both EVA and POLYSCAN are both discussed herein, it is contemplated that other materials and coatings may be used to form the floatation device to accommodate users of different sizes and weights.

Figure 4:
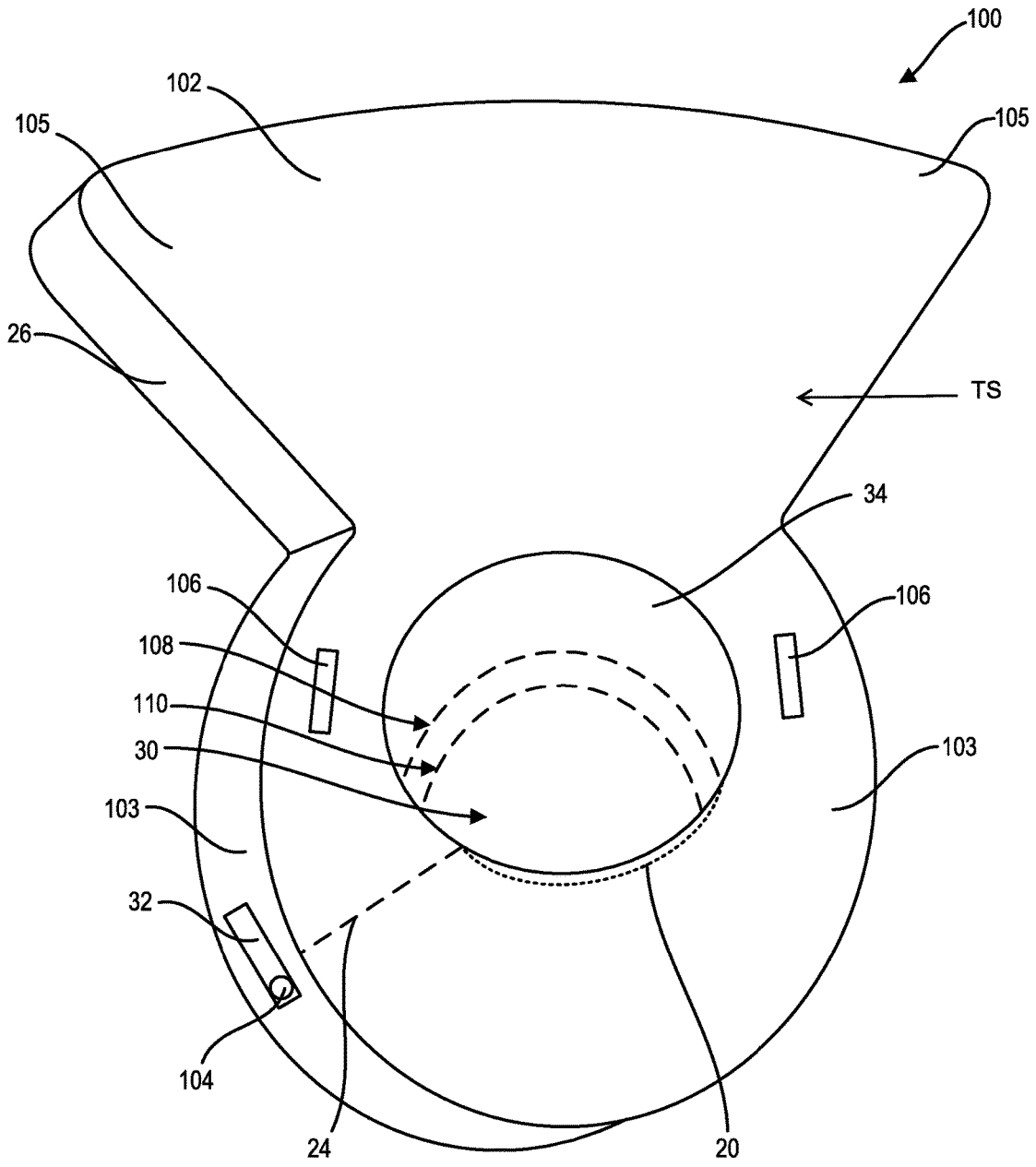
FIG. 4 is a top elevational view of an alternate embodiment of the floatation device of the present invention.

With reference to FIG. 4, an additional embodiment of floatation device 100 is shown, which has a body formed as a single piece of safety foam as in the previous embodiments. Floatation device 100 is comprised of a front extension 101, two side extensions 103, and an enlarged back extension 102. The outer side wall 26 is an outermost portion of the front extension 101, two side extensions 103, and the back extension 102. Back extension 102 has a fin-like shape, which could also be described as a partial triangle. The outermost ends 105 of back extension 102 provide enlarged portions of buoyant material to prevent a user from flipping on his or her back due to excessive play or movement. Some embodiments with a front extension may include a chin platform, and the chin platform is located nearest to the front extension between the level portion and the inner opening.

The floatation device 100 includes a division 24 where the user can separate the portions of the floatation device 100 in order to place the floatation device 100 around the user's neck. The portions of the floatation device 100 on either side of the division 24 are configured to align when drawn together and secured by a locking mechanism. In one embodiment of the present invention, the locking mechanism is made up of locking straps 32 and clasp 104. The outer diameter of the floatation device 100 can include curved edges 14 (not shown) that lead to outer side wall 26, which then transitions into bottom portion(s) 28 (not shown).

Figure 5:
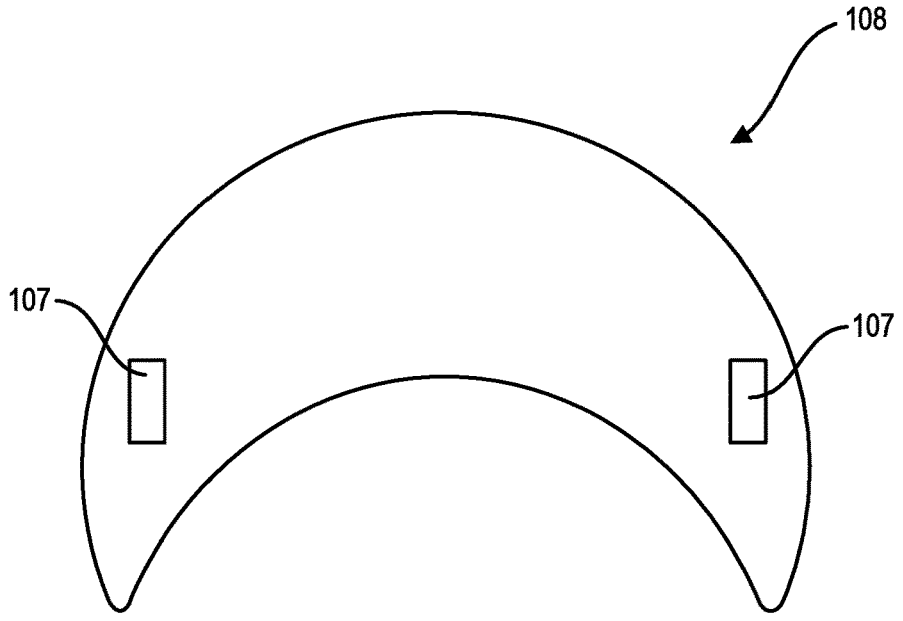
FIG. 5 is a top view of a first removable insert for adjusting the diameter of the inner opening of the floatation device of the present invention.
Figure 6:
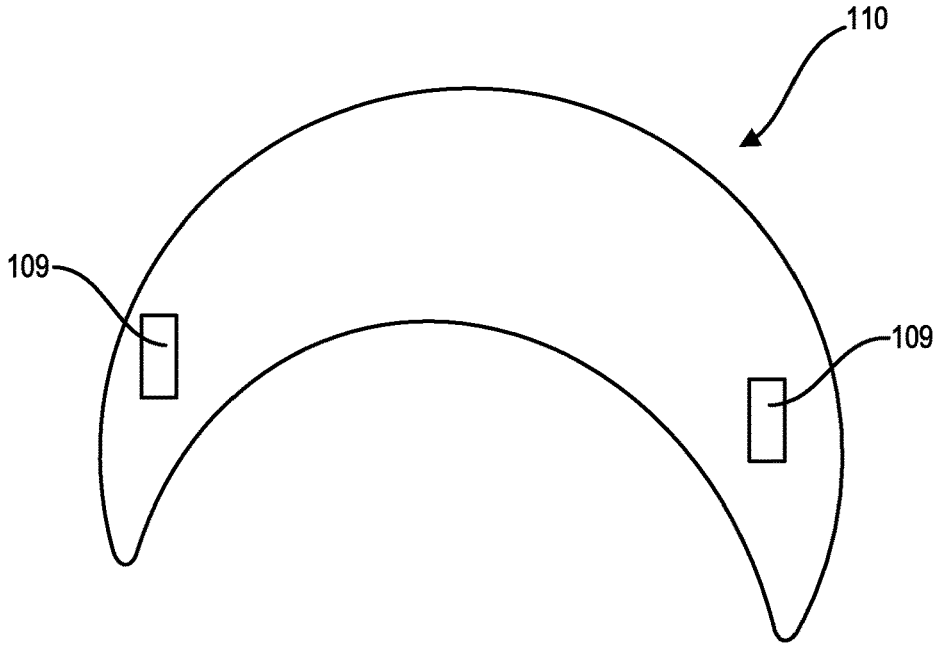
FIG. 6 is a top view of a second removable insert for adjusting the diameter of the inner opening of the floatation device of the present invention.

Applicable to all embodiments but shown for the first time in FIGS. 4-6, floatation device 100 includes first insert 108 and second insert 110. Both inserts are removable and allow the same floatation device 100 to have three different sizes, which, when used with an infant, allows the floatation device 100 to grow with the infant or be used by different infants having different sizes. Insert 108 is received within inner opening 22 of floatation device 100. In one embodiment of the invention this will decrease inner opening 22 from a diameter of approximately 3.5 inches to approximately 3.0 inches. Insert 108 is held in place using straps that are inserted through loop apertures 106 of floatation device 100 and apertures 107 of insert 108. To further decrease the diameter of inner opening 22, insert 110 is received within insert 108 and both inserts 108 and 110 are held in place using straps that are inserted through loop apertures 106 of floatation device 100 and apertures 107 and 109 of inserts 108 and 110, respectively. In some embodiments, inserts 108 and 110 are made of the same material from which the floatation device 100 is fabricated to aid in its buoyancy, although different material from which the floatation device 100 is fabricated may also be used.

Figure 7:
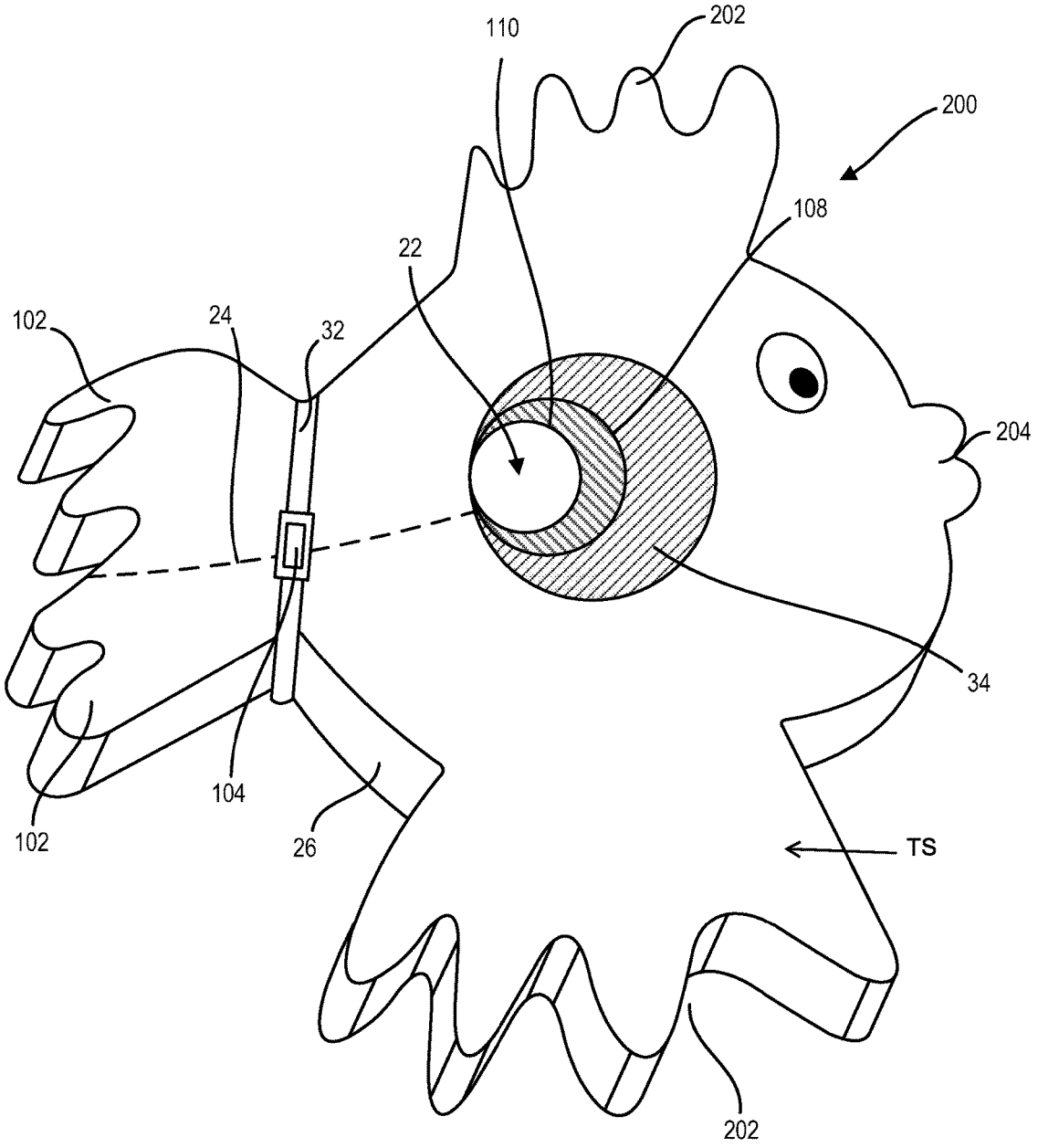
FIG. 7 is a top elevational view of a further alternative embodiment of the floatation device of the present invention.
Figure 8:
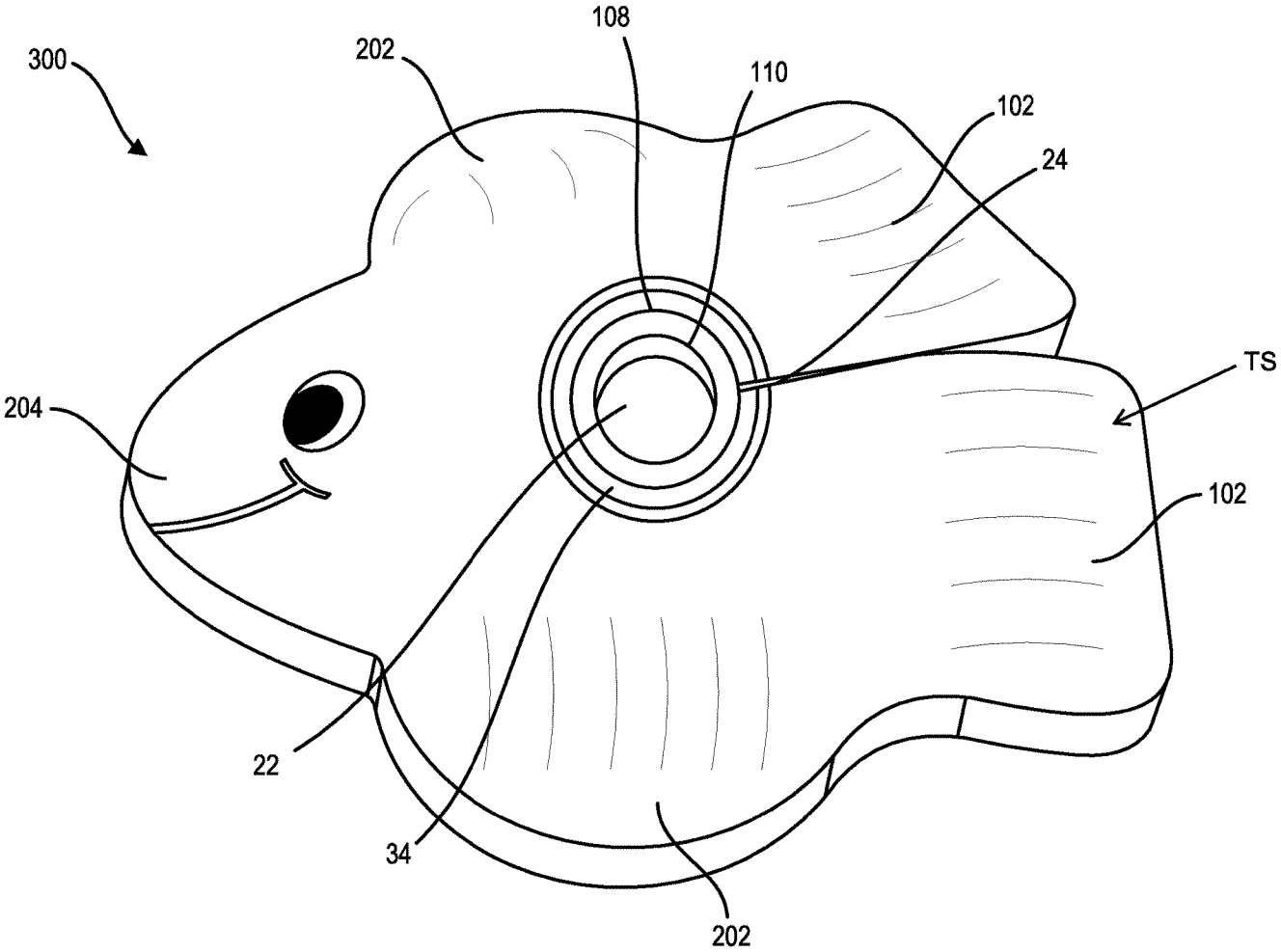
FIG. 8 is a top elevational view of another alternative embodiment of the floatation device of the present invention.

With reference to FIGS. 7 and 8, two additional embodiments of the invention are disclosed. Although different in appearance, infant floatation devices 200 and 300 in FIGS. 7 and 8, respectively, are similar functionally. Infant floatation device 200 in FIG. 7 is designed to look like a fish and has a body made up of a one-piece design of safety foam, as in previous embodiments, with front extension 204, two side extensions 202, and two back extensions 102 separated by division 24. The outer side wall 26 is an outermost portion of the front extension 204, two side extensions 202, and the back extensions 102.

As previously described, when used with infants, floatation device 200 may include inserts 108 and 110 to allow for different size infants. Back extensions 102 provide extra buoyancy at the back of the infant's head to prevent the floatation device 200 and the infant from tipping backwards. Side extensions 202 and front extension 204 provide additional buoyancy and stability in all directions for the infant as previously described. The back extensions 102 of the device 200 on either side of division 24 are configured to align when drawn together and secured by a locking mechanism. In this embodiment of the present invention, the locking mechanism is made up of locking straps 32 and clasp 104.

Floatation device 300 in FIG. 8 is also designed to look like a fish and has a body made up of a one-piece design of safety foam, as in all previous embodiments, with front extension 204, two side extensions 202, and two back extensions 102 separated by division 24. As described in reference to previous embodiments, floatation device 300 includes inserts 108 and 110 to allow for users of different sizes and, in particular, infants.

Figure 11:
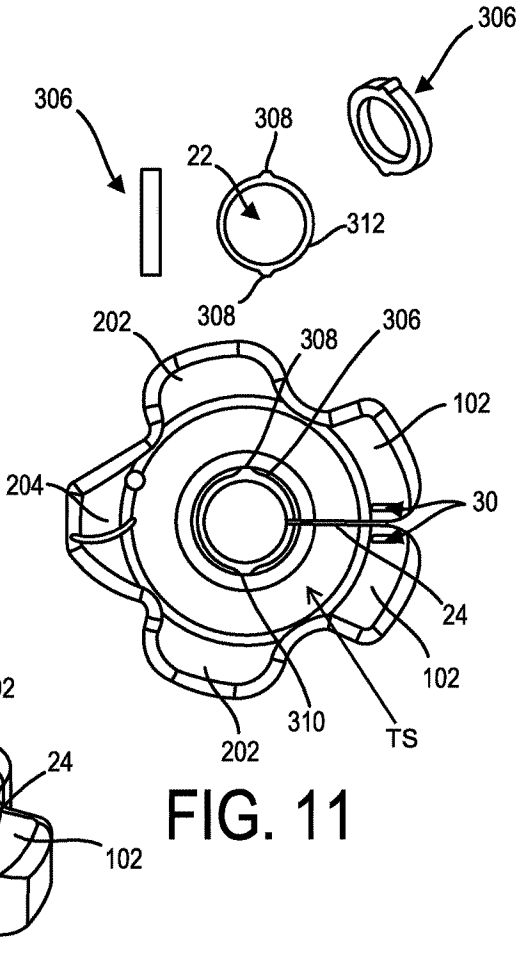
FIG. 11 is a top elevational view of the embodiment of FIG. 8 with an alternative third sizing insert.
Figure 10:
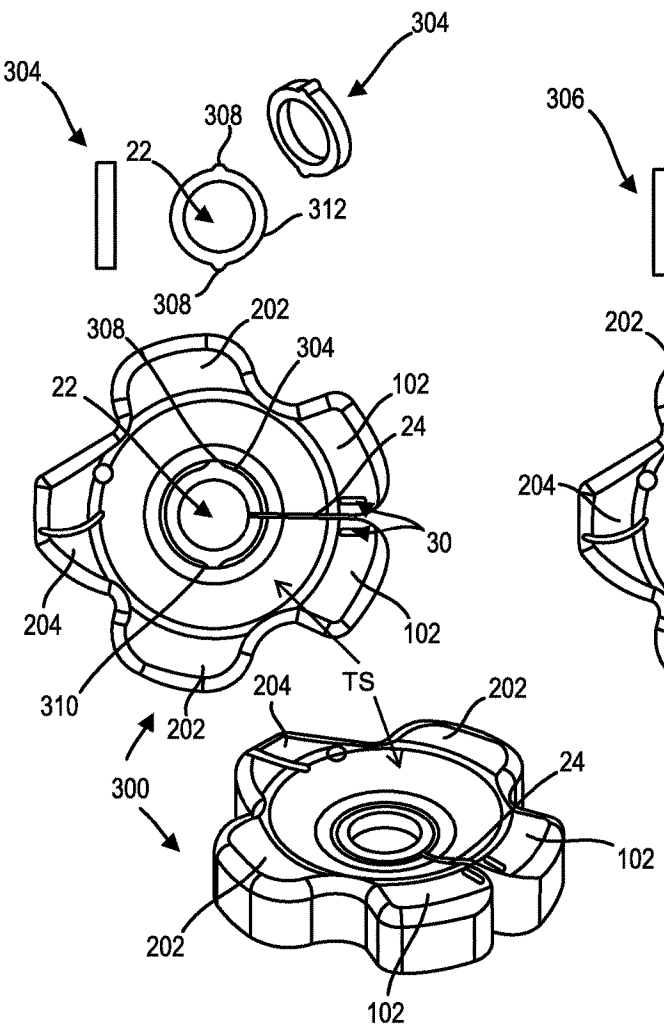
FIG. 10 is a top elevational view of the embodiment of FIG. 8 with an alternative second sizing insert.
Figure 9:
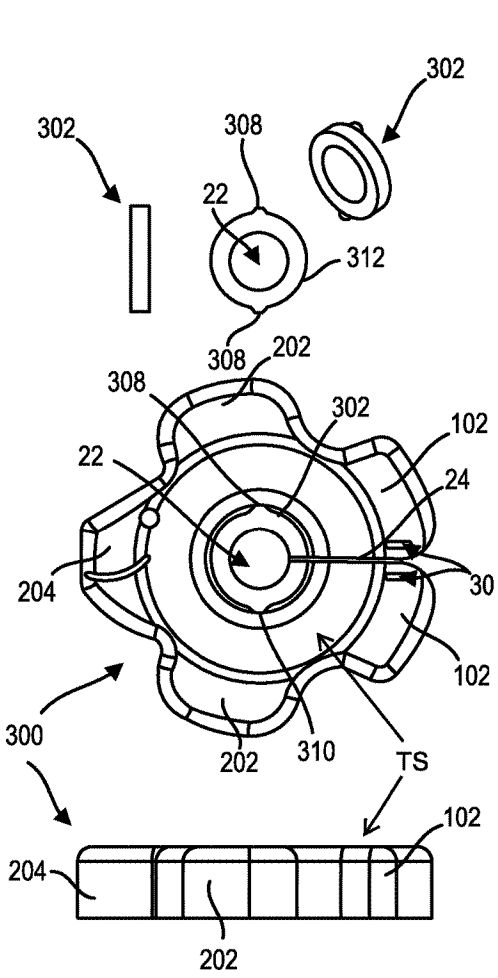
FIG. 9 is a top elevational view of the embodiment of FIG. 8 with an alternative first sizing insert.

FIGS. 9-11 illustrate floatation device 300 with an alternative embodiment of the size inserts. Instead of a stacking arrangement of inserts, an alternative embodiment employs three separate and interchangeable inserts: first insert 302, second insert 304, and third insert 306. Each insert 302, 304, and 306 is preferably formed from the same safety foam as the floatation device 300 is fabricated, although each insert 302, 304, and 306 may also be formed from a different safety foam as the floatation device 300. The primary difference between the three inserts is the size of the inner opening 22, thereby allowing each insert to be used for different sized users and, in particular, infants.

First insert 302 is comprised of a ring shaped structure having an inner opening 22, one or more locking members 308 extending from its outer diameter, and a division 312 that splits the first insert 302 so it can be opened along with division 24 in floatation device 300 to then place around the neck of a user. First insert 302 is received within inner opening 22 of floatation device 300, which now includes one or more notches 310 into which locking members 308 of first insert 302 are received. This locking arrangement aligns division 312 of first insert 302 with division 24 of floatation device 300 so that they both open together to then fit around the neck of a user. To use floatation device 300 with a larger user and, in particular, a larger child, the user simply removes first insert 302 and replaces it with either second insert 304 or third insert 306.

Figure 12:
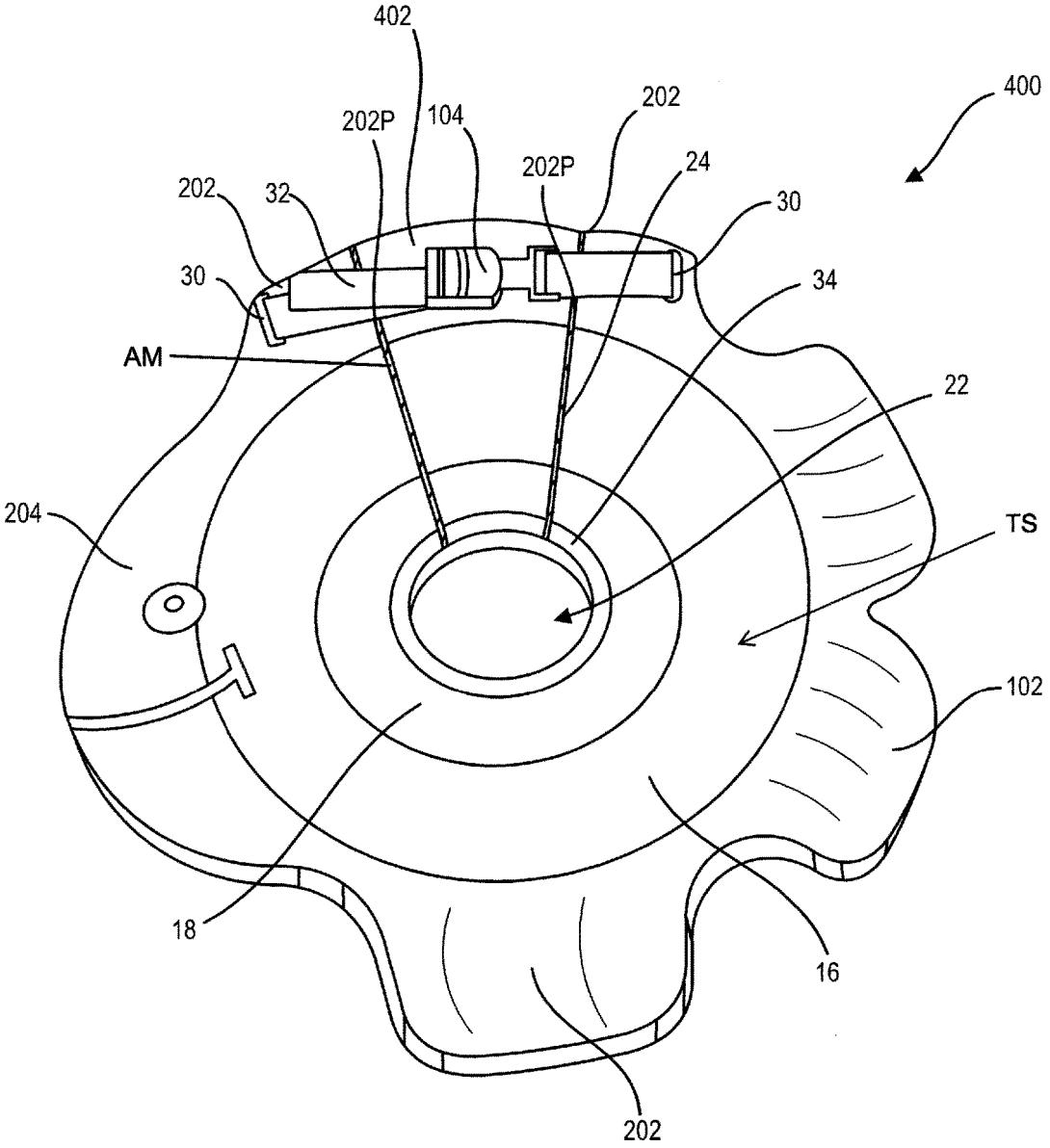
FIG. 12 is a top elevational view of an embodiment of the floatation device of the present invention.

FIG. 12 illustrates an alternate embodiment of floatation device 400 having a front extension 204, side extensions 202, and back extensions 102. As previously described, floatation device 400 has a generally round and downwardly sloped portion 16, which then ends in leveled portion 18 and inner opening 22. In this embodiment, side extension 202 has a division 24, and the portions of side extension 202 on either side of division 24 are configured to align when drawn together and secured by a locking mechanism. As illustrated in FIG. 12, the locking mechanism comprises apertures 30 in each of the opposing side extension portions 202P of side extension 202 that receive locking strap 32 which may then be fastened by clasp 104. Although only one locking strap 32 and one clasp 104 is illustrated, it is contemplated that there may be more than one locking strap 32 and/or more than one clasp 104 utilized with this embodiment. For example, an additional locking strap 32 and clasp 104 may be included on the bottom portions 28 of the floatation device (not shown).

In order to accommodate users of a larger size, wedge insert 402 may be inserted between the portions of side extension 202 on either side of division 24. In some embodiments, the wedge insert 402 is made with a commercial grade adhesive material (such as, for example, the Velcro® hook and loop fastener) AM on at least one of the interior sides thereof in order to better attach to the corresponding opposing side extension portion(s) 202P of side extension 202, which also may include the appropriate adhesive material AM. In some embodiments, one side of wedge insert 402 does not include a commercial grade adhesive material AM in order to better allow for opening and closing of floatation device 400 around the user and, in particular, the infant.

Although it is contemplated that any number of different sized wedge inserts 402 may be used, four exemplary sizes of floatation device 400 will be described. First, without a wedge insert 402, the inner diameter of floatation device 400 is approximately 2.5 inches and can generally accommodate an infant weighing between approximately 5 and 7 pounds. Second, with a wedge insert 402 having an outermost diameter of 1 inch and an innermost diameter of 0.75 inches inserted into the division 24 between the portions of side extension 202, the inner diameter of the floatation device 400 is approximately 3 inches×2.5 inches and can generally accommodate an infant weighing between approximately 7 and 10 pounds. Third, with a wedge insert 402 having an outermost diameter of 2 inches and an innermost diameter of 1.5 inches inserted into the division 24 between the portions of side extension 202, the inner diameter of the floatation device 400 is approximately 3 inches×3.5 inches and can generally accommodate an infant weighing between approximately 10 and 15 pounds. Last, with a wedge insert 402 having an outermost diameter of 3 inches and an innermost diameter of 2.25 inches inserted into the division 24 between the portions of side extension 202, the inner diameter of the floatation device 400 is approximately 4 inches×3.5 inches and can generally accommodate an infant weighing between approximately 15 and 20 pounds.

Figure 13:
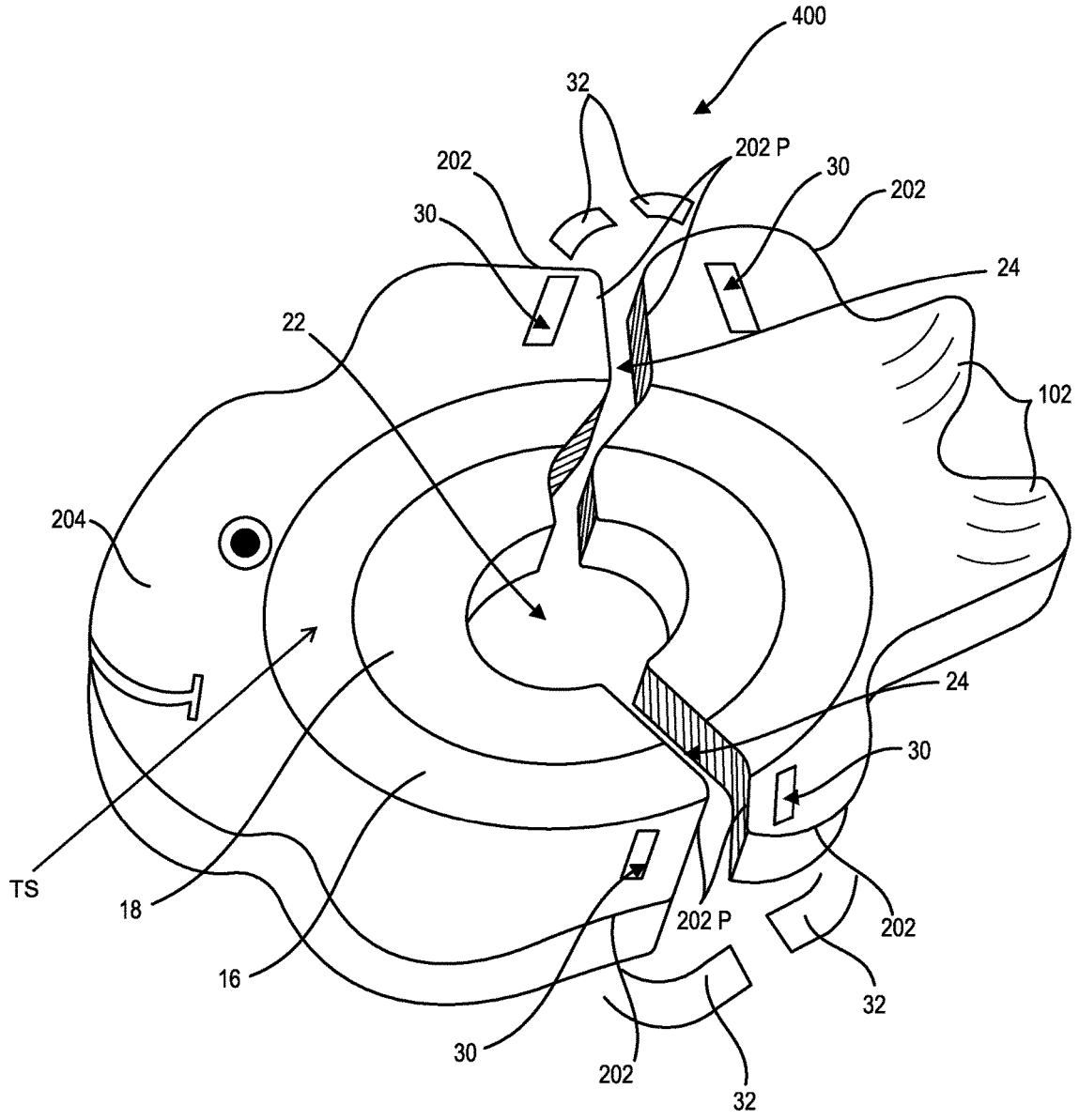
FIG. 13 is a top elevational view of an embodiment of the floatation device of the present invention.

FIG. 13 illustrates an embodiment of the floatation device 400 of FIG. 12 in which both side extensions 202 may be separated by a division 24 such that the wedge inserts 402, as previously described, may be used in one or both of the side extensions 202 in order to properly accommodate a user and, in particular, an infant. When more than one insert 402 is used, it allows for a more comfortable application to a user by avoiding the need to pry open a tighter opening, which may cause discomfort for the user.

The examples are illustrative only and not meant to limit the invention, as measured by the scope and merit of the claims. The invention has been described with reference to preferred and alternate embodiments. Obviously, modifications and alterations will occur to others upon the reading and understanding of the specification. It is intended to include all such modifications and alterations insofar as they come within the scope of the appended claims or the equivalents thereof.

What is claimed is:

1. A floatation device comprising:

a body fabricated from a buoyant foam wherein said body comprises:

an outer side wall;

a top side comprising:

a downwardly sloped portion, wherein the downwardly sloped portion extends inwardly from the outer side wall; and a level portion wherein the downwardly sloped portion extends into and connects said level portion to the outer side wall;

an inner opening at a center of the level portion, wherein said body includes a division extending from the outer side wall to the inner opening; and a locking mechanism, wherein the locking mechanism comprises one or more apertures within the floatation device and one or more locking straps, wherein the one or more locking straps are located partially within at least one of the one or more apertures.

2. The floatation device of claim 1, the device further comprising an inner side wall, wherein the inner side wall surrounds the inner opening at the center of the level portion.

3. The floatation device of claim 1, the device further comprising one or more curved edges, wherein the curved edges lead from the top side of the floatation device to the outer side wall.

4. The floatation device of claim 1, the device further comprising a chin platform, wherein the chin platform is between the level portion and the inner opening.

5. The floatation device of claim 1, the device further comprising one or more bottom portions, wherein the outer side wall transitions from the top side of the floatation device to the one or more bottom portions.

6. The floatation device of claim 1, wherein the body of the device is formed of ethylene vinyl acetate and coated with POLYSCAN Liquid Power.

7. The floatation device of claim 1, wherein the device further comprises one or more front extensions, wherein the outer side wall is an outermost portion of the one or more front extensions.

8. The floatation device of claim 7, wherein the device further comprises one or more rear extensions, wherein the outer side wall is an outermost portion of the one or more rear extensions.

9. The floatation device of claim 8, wherein the device further comprises one or more side extensions, the one or more side extensions being located between the one or more front extensions and the one or more rear extensions, wherein the outer side wall is an outermost portion of the one or more side extensions.

10. The floatation device of claim 9, wherein the device further comprises a chin platform wherein the chin platform located nearest to the one or more front extensions and between the level portion and the inner opening.

11. A floatation device comprising:

a body fabricated from a buoyant foam wherein said body comprises:

an outer side wall;

a top side comprising:

a downwardly sloped portion, wherein the downwardly sloped portion extends inwardly from the outer side wall; and a level portion wherein the downwardly sloped portion extends into and connects said level portion to the outer side wall;

an inner opening at a center of the level portion, wherein said body includes a division extending from the outer side wall to the inner opening;

one or more front extensions, wherein the outer side wall is an outermost portion of the one or more front extensions;

one or more rear extensions, wherein the outer side wall is an outermost portion of the one or more rear extensions;

one or more side extensions, the one or more side extensions being located between the one or more front extensions and the one or more rear extensions, wherein the outer side wall is an outermost portion of the one or more side extensions, further wherein the division is located on one of the one or more side extensions such that the one of the one or more side extensions contains opposing side extension portions; and an insert, wherein the insert is capable of being inserted into the division between the opposing side extension portions.

12. The floatation device of claim 11, wherein one of the opposing side extension portions and one side of the insert contains an adhesive material.

13. The floatation device of claim 11, wherein both of the opposing side extension portions and two sides of the insert contain an adhesive material.

14. The floatation device of claim 11, the device further comprising a locking mechanism, wherein the locking mechanism comprises one or more apertures within the opposing side extension portions and one or more locking straps, wherein the one or more locking straps are located partially within at least one of the one or more apertures.

15. A floatation device comprising:

a body fabricated from a buoyant foam wherein said body comprises:

an outer side wall;

a top side comprising:

a downwardly sloped portion, wherein the downwardly sloped portion extends inwardly from the outer side wall; and a level portion wherein the downwardly sloped portion extends into and connects said level portion to the outer side wall;

an inner opening at a center of the level portion, wherein said body includes a division extending from the outer side wall to the inner opening;

one or more front extensions, wherein the outer side wall is an outermost portion of the one or more front extensions;

one or more rear extensions, wherein the outer side wall is an outermost portion of the one or more rear extensions;

one or more side extensions, the one or more side extensions being located between the one or more front extensions and the one or more rear extensions, wherein the outer side wall is an outermost portion of the one or more side extensions, further wherein the division is located on the one or more side extensions such that each of the one or more side extensions contain opposing side extension portions; and one or more inserts, wherein each of the one or more inserts is capable of being inserted into the division between the opposing side extension portions of each of the one or more side extensions.

16. The floatation device of claim 15, wherein one of the opposing side extension portions of each of the one or more side extensions and one side of each of the one or more inserts contains an adhesive material.

17. The floatation device of claim 15, wherein both of the opposing side extension portions of each of the one or more side extensions and two sides of each of the one or more inserts contains an adhesive material.

18. The floatation device of claim 15, the device further comprising a locking mechanism, wherein the locking mechanism comprises one or more apertures within the opposing side extension portions and one or more locking straps, wherein the one or more locking straps are located partially within at least one of the one or more apertures.

19. The floatation device of claim 15, wherein the device is capable of being separated into two separate components along an axis of the divisions.

* * * * *